United States Patent [19]

Katoh et al.

[11] Patent Number: 4,952,484

[45] Date of Patent: Aug. 28, 1990

[54] SILVER HALIDE PHOTOGRAPHIC MATERIAL

[75] Inventors: Kazunobu Katoh; Keiichi Adachi, both of Kanagawa, Japan

[73] Assignee: Fuji Photo Film Co., Ltd., Kanagawa, Japan

[21] Appl. No.: 313,004

[22] Filed: Feb. 21, 1989

[30] Foreign Application Priority Data

Feb. 18, 1988 [JP] Japan ..... 63-036165

[51] Int. Cl.[5] ..... G03C 1/84; G03C 1/32

[52] U.S. Cl. ..... 430/496; 430/264; 430/512; 430/517; 430/518; 430/950

[58] Field of Search ..... 430/950, 496, 517, 512, 430/518, 264

[56] References Cited

U.S. PATENT DOCUMENTS

| | | | |
|---|---|---|---|
| 1,631,421 | 6/1927 | Lohofer | 430/517 |
| 4,247,627 | 1/1981 | Chen | 430/517 |
| 4,409,322 | 10/1983 | Ezaki et al. | 430/950 |
| 4,857,443 | 8/1989 | Aono et al. | 430/950 |

*Primary Examiner*—Richard L. Schilling

*Attorney, Agent, or Firm*—Sughrue, Mion, Zinn, Macpeak & Seas

[57] ABSTRACT

A silver halide photographic material comprising a support having thereon at least one silver halide emulsion layer, wherein said emulsion layer or other hydrophilic colloid layer contains a colored polymer matting agent. The colored matting agent comprises a dye adsorbed to a polymer. The dye is selected to adsorb light in the same wavelength region that to which the photographic material is exposed. Use of the present invention inhibits the occurrence of black spots.

10 Claims, No Drawings

SILVER HALIDE PHOTOGRAPHIC MATERIAL

FIELD OF THE INVENTION

This invention relates to silver halide photographic materials and particularly to silver halide photographic materials containing polymer matting agents for use in photomechanical processes.

BACKGROUND OF THE INVENTION

In the field of graphic arts, a high contrast image-forming system is used to obtain good reproduction of continuous tone images comprising dot images or good reproduction of line images. For this purpose, a lith developer system has been heretofore employed.

In order to obtain the photographic characteristic of high contrast using stable developing solutions, a method has been developed and principally employed using hydrazine derivatives as described in U.S. Pat. Nos. 4,224,401; 4,168,977; 4,166,742; 4,311,781; 4,272,606; 4,211,857; and 4,243,739. This method provides high contrast and high sensitivity and allows sulfite to be added in high concentration to the developing solution so that the stability of the developing solution against air oxidation is greatly improved as compared to the lith developer. Also, the surfaces of photographic materials for use in photo-mechanical processes (the upper layer of photographic emulsion layers or the back layers) are matted to prevent the occurrence of uneven images due to the formation of Newton rings and to carry out uniform vacuum-enlarging in a short time when conducting camera work or print work. The thus matted surfaces do not adhere to one another when the photographic materials are stored. Finely-powdered inorganic water-insoluble compounds such as silica, alumina, barium sulfate, and calcium carbonate and finely-powdered organic compounds such as starch, polymethylmethacrylate, and polystyrene have been used as matting agents. Of these, polymer matting agents are preferable because the desired uniform grain size is easily obtained.

However, the use of polymer matting agents causes small black spots on the blackened edges of the images. The inventors have studied this phenomenon and have found that the areas of the photographic material containing the polymer matting agents have a higher value of optical transmission and are therefore fogged to result in black spots. Moreover, it has been found that the coexistence of the polymer matting agents and optical filter dyes brings about even more distinct black spots. Thus, the problem of black spots caused by light leakage needed to be solved.

SUMMARY OF THE INVENTION

An object of the present invention is to provide silver halide photographic materials containing novel polymer matting agents which inhibit the occurrence of black spots.

Another object of the present invention is to provide silver halide photographic materials containing the novel polymer matting agents of the present invention in the upper most layer of the silver halide photographic materials.

A third object of the present invention is to provide silver halide photographic materials containing the novel polymer matting agents of the present invention in the upper most layer of the back (side of the support opposite that having the silver halide emulsion layer) layers.

The above-mentioned objectives of the present invention are attained by a silver halide photographic material comprising a support having thereon at least one silver halide emulsion layer, wherein the emulsion layer or other hydrophilic colloid layer contains a colored polymer matting agent.

DETAILED DESCRIPTION OF THE INVENTION

The colored polymer matting agents for use in the present invention are prepared by incorporating or adsorbing dyes in the inside or on the surface of fine particles of a polymer.

The polymer for use as a polymer matting agent of the present invention is selected from acryl resin, vinyl chloride resin, vinyl acetate resin, styrol resin, vinylidene chloride resin, acetal resin, and cellulose resin. These resins are preferably dispersed in water, gelatin or a water-soluble polymer such as polyacrylamide having an average grain size of from 0.1 to 10 $\mu$m, and preferably 0.5 to 5 $\mu$m. When these resins are used in the backing layers with binders such as gelatin and hydrophilic polymers, e.g., polyacrylamide or sodium polyacrylate, the resins are preferably dispersed as described above. When these resins are used in the backing layers with hydrophobic binders in an organic solvent, polymers prepared by copolymerizing monomers particularly having multifunctional crosslinking groups among the above-described polymers are preferably dispersed in the organic solvent.

The polymer for use as a polymer matting agent of the present invention has a molecular weight of from about 3,000 to about 200,000, preferably from about 5,000 to about 100,000.

The following are polymers for use as polymer matting agents of the present invention, but the scope of the present invention is not restricted thereby.

(1) Acryl resins including polymethyl methacrylate, polyethyl methacrylate, poly n-propyl methacrylate, poly n-butyl methacrylate, polydimethylaminoethyl methacrylate, polymethyl acrylate, polyethylacrylate, and polymethoxyethyl acrylate.

(2) Copolymerized acryl resins including copolymerized resins of monomers of the resins described in (1) and vinyl chloride, vinyl acetate, vinylidene chloride, vinyl pyridine, styrene, acrylonitrile, acrylic acid or methacrylic acid.

(3) Vinyl chloride resins including copolymerized resins of polyvinyl chloride or vinyl chloride and vinyl acetate, vinylidene chloride, acrylic acid, methacrylic acid, maleic acid, maleic acid ester, or acrylonitrile.

(4) Polyvinyl acetate and the partially saponificated resin thereof.

(5) Styrol resins including copolymerized resins of polystyrene or styrene and acrylonitrile.

(6) Vinylidene chloride resins including copolymerized resins of polyvinylidene chloride or vinylidene chloride and acrylonitrile.

(7) Acetal resins including polyvinyl formal and polyvinyl butyral.

(8) Cellulose resins including cellulose acetate, cellulose propionate, cellulose butyrate, and cellulose nitrate.

The above-mentioned copolymers consist only of two components, but may consist of three or four components. Monomers for copolymerization can be selected from the above resins. For example, the examples of the three-component copolymer include polymethylmethacrylate/n-butylacrylate/acrylic acid copolymer in a molar ratio of 50/35/15, and the examples of the four-component copolymer include polymethylmethacrylate/styrene/acrylic acid/methylol acrylamide in a molar ratio of 40/40/10/10. When the polymers are copolymers consisting of two components, the copolymerization ratio of the components is in a range of from 5/95 to 95/5, preferably 10/90 to 90/ 10 by mol.

Dispersions of the polymers of the present invention are prepared by (A) dissolving the polymer in an organic solvent and then vigorously stirring with water or an aqueous gelatin solution to be dispersed, or (B) polymerizing monomers by emulsion polymerization, precipitation polymerization, or pearl polymerization to separate out the polymer particles.

The organic solvent is selected from polymer compatible organic solvents such as ethyl acetate, methylene chloride, ethylene dichloride, acetone, alcohol, chloroform, carbon tetrachloride, benzene, toluene, tetrahydrofuran, dichlorohexanone, dioxane, methyl ethyl ketone, and o-chlorobenzene. Preferably, these solvents are removed by heating or by evaporation under reduced pressure after dispersion. Organic solvents which are partially soluble in water such as ethyl acetate, acetone and alcohol can be removed by ultrafiltration.

In dispersion method (A), dyes to be used for coloring the polymers are dissolved in organic solvents together with the polymers, or are dissolved in organic solvents separately from the polymers and then mixed with the polymer dispersions with stirring. In method (B), the dyes are previously mixed with the monomers or the dyes, having been dissolved in organic solvents, are mixed with the resulting polymers after polymerization and then adsorbed inside or on the surface of the polymer particles by gradually removing the organic solvents.

The dyes to be used for coloring the polymer matting agents of the present invention are those which have the desired absorption wavelengths covering the range of the ultraviolet, visible and infrared rays, selected from cyanine dyes, merocyanine dyes, hemicyanine dyes, oxonol dyes, styryl dyes, benzylidene dyes, azo dyes, azomethine dyes, anthraquinone dyes, diphenyl methane dyes or triphenyl methane dyes, acridine dyes, xanthene dyes, diaminostilbene dyes, benzophenone dyes, benzotriazole dyes, cinnamic acid dyes and aminobutadiene dyes.

The dyes for use in the present invention may be soluble in water or in organic solvent, but the dyes and the polymers of the present invention are preferably soluble in the same solvent.

The dyes for use in the present invention are preferably those which are eluted or decolored from the polymer matting agents during development.

The following are the examples of the dyes for use in the present invention but the scope of the present invention is not restricted thereby.

1

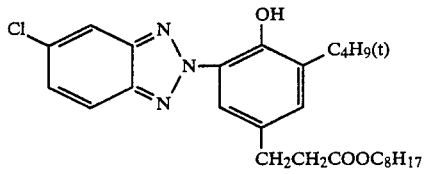

2

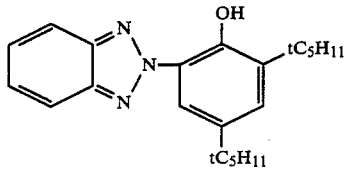

3

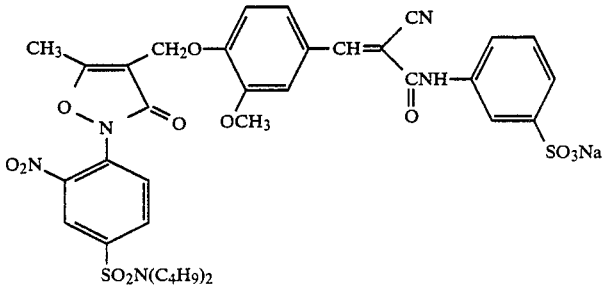

-continued
4
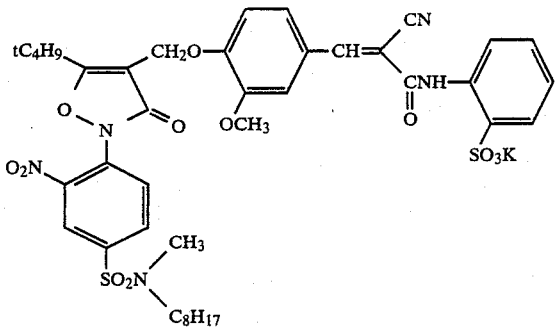
5
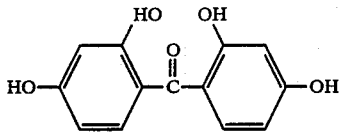
6
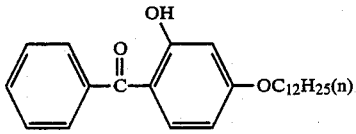
7
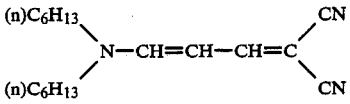
8
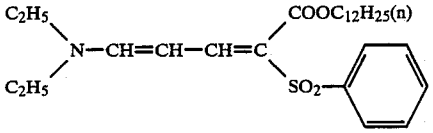
9
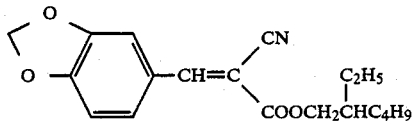
10
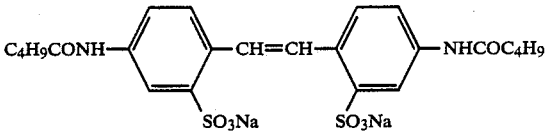
11
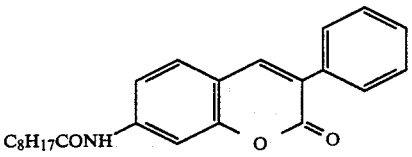
12
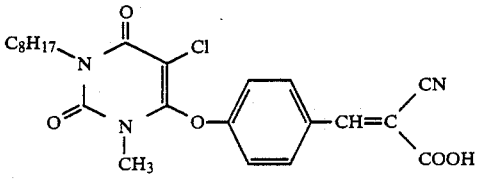

-continued
13
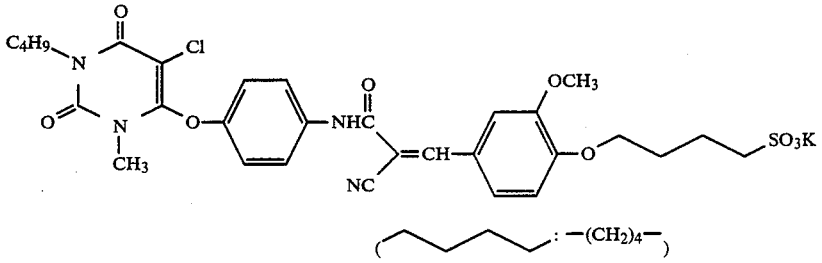
14
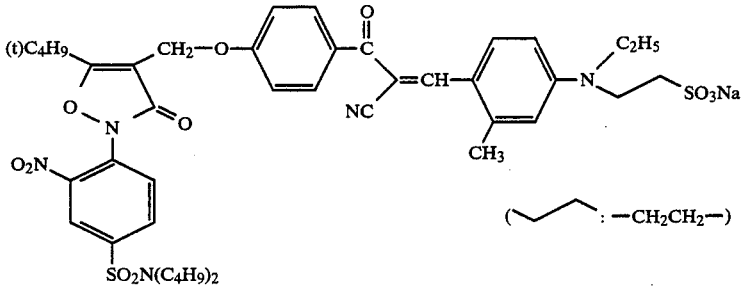
15
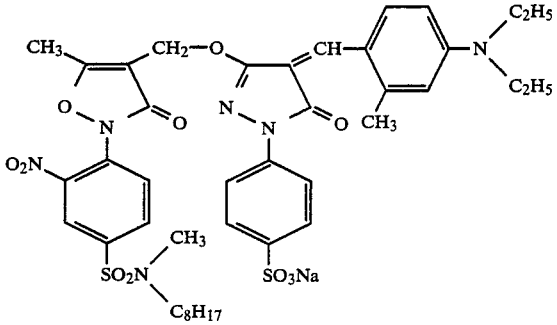
16
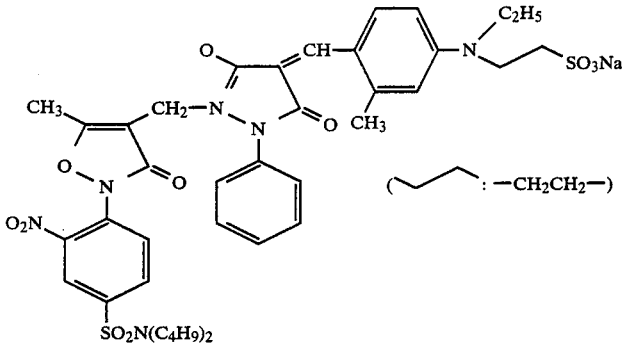
17
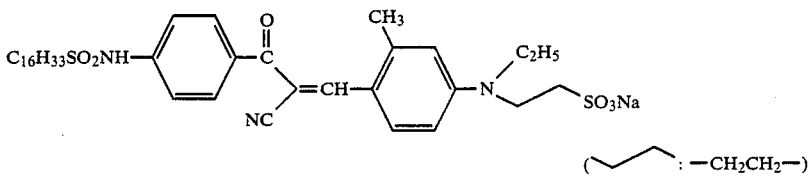

-continued
18
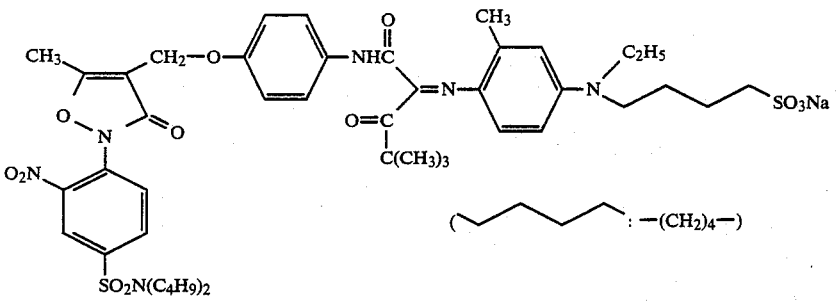
19
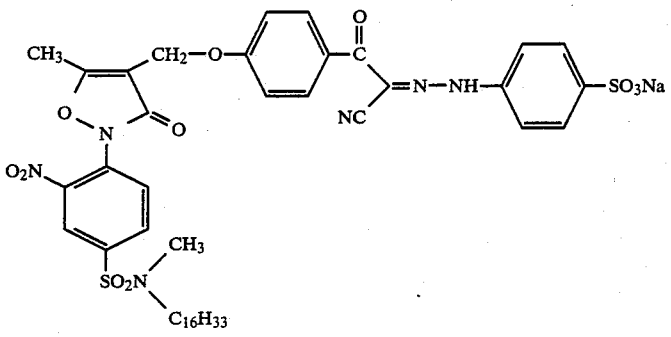
20
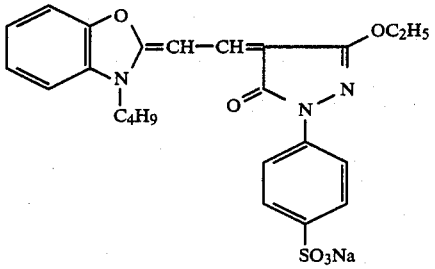
21
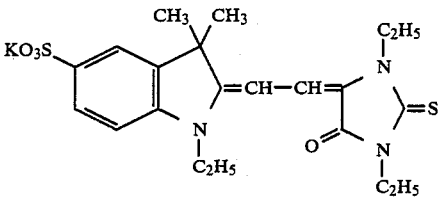
22
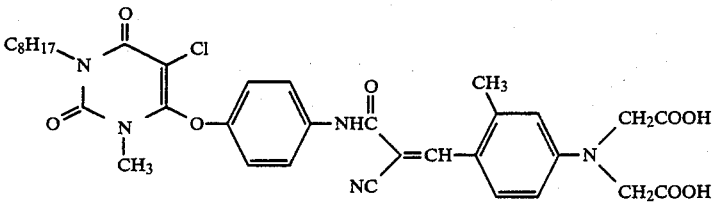
23
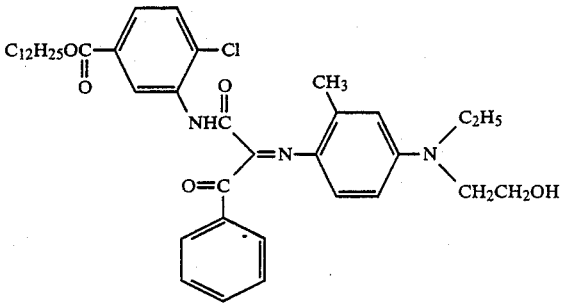

-continued
24
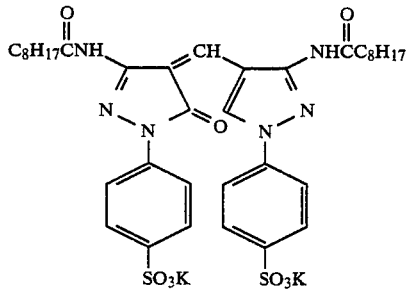
25
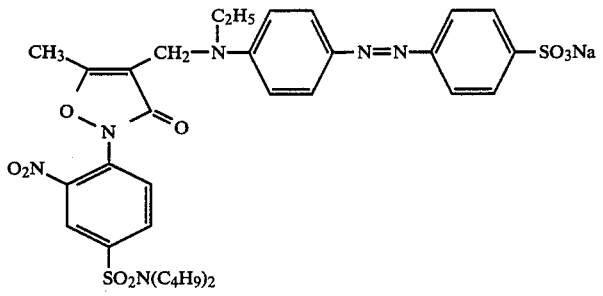
26
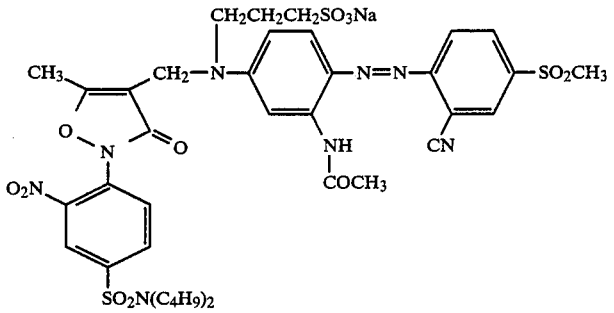
27
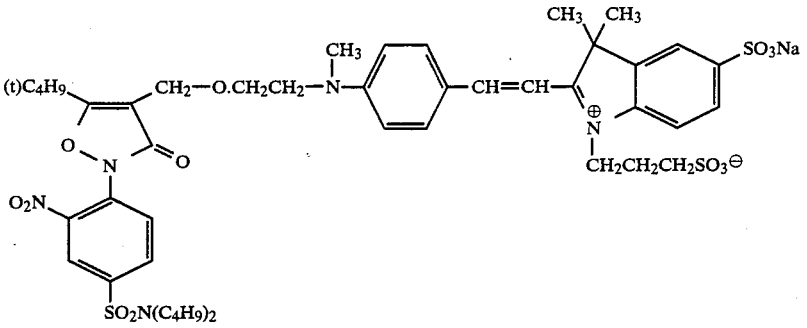
28
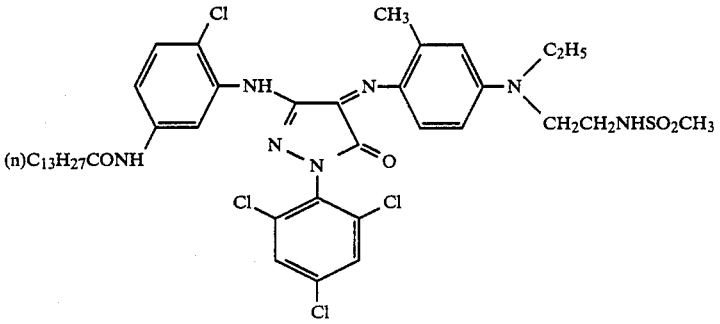

-continued
29
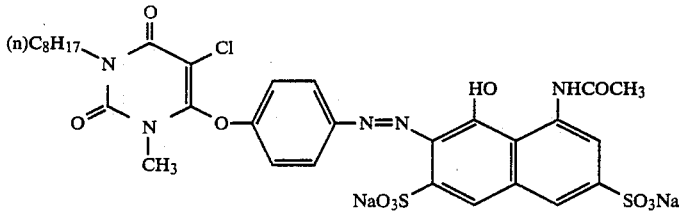
30
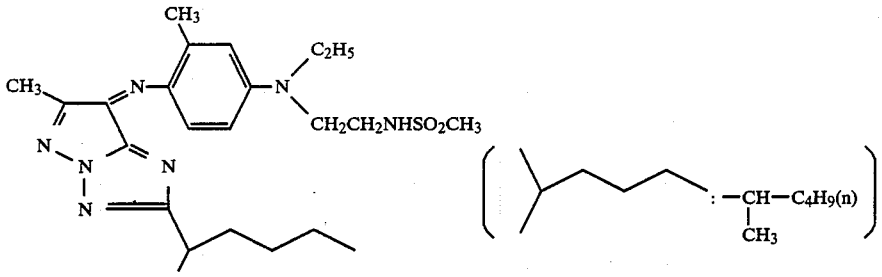
31
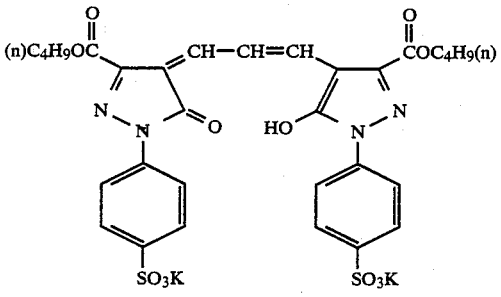
32
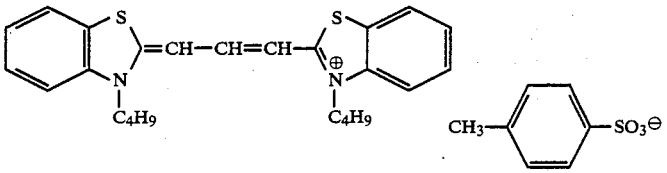
33
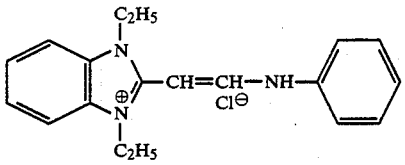
34
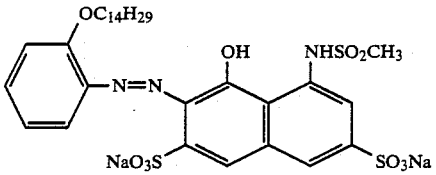
35
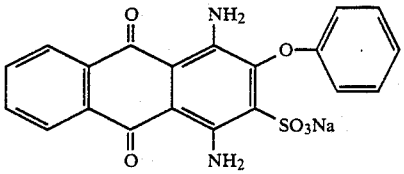

-continued
36
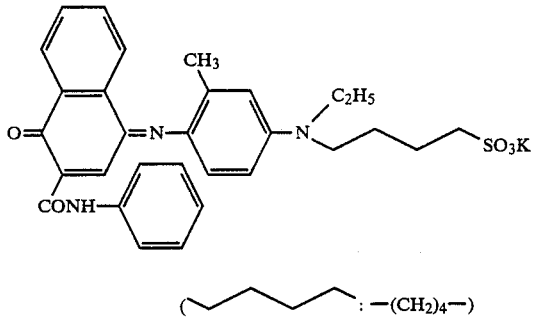
37
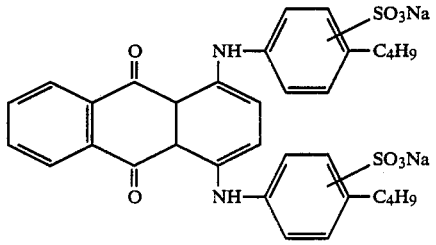
38
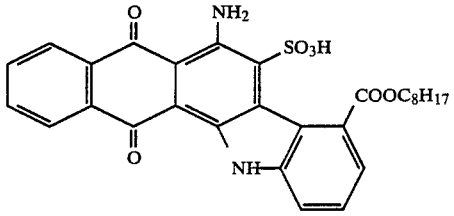
Aizen Spilon Blue GNH (made by Hodogaya Chemical Co., Ltd.) 39
40
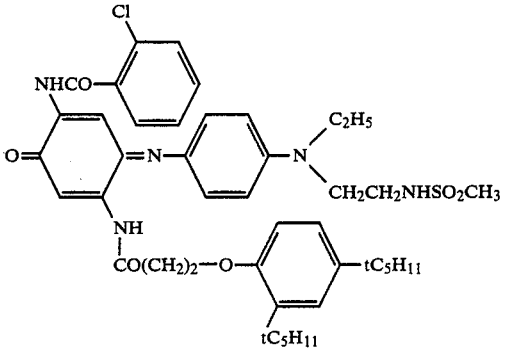
41
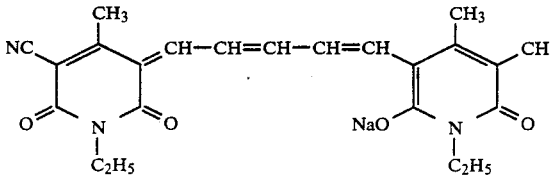

-continued
42
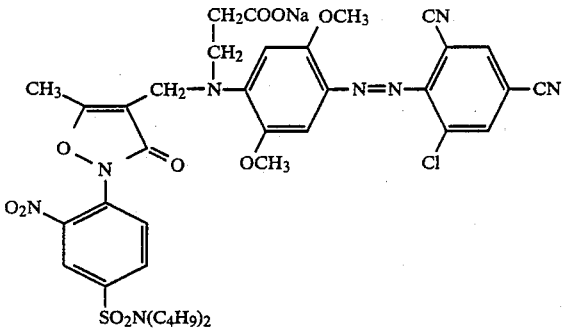
43
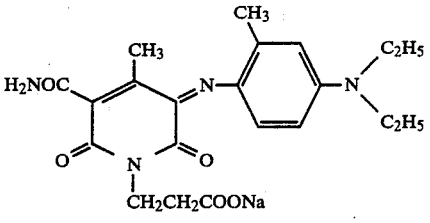
44
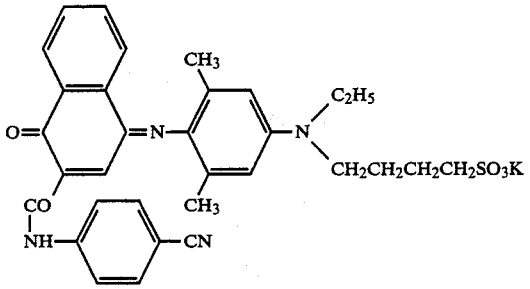
45
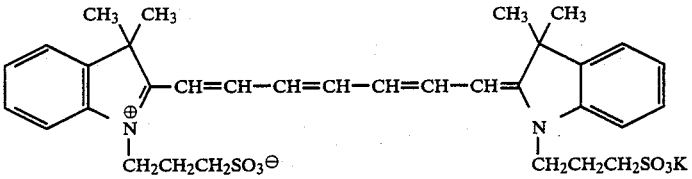
46
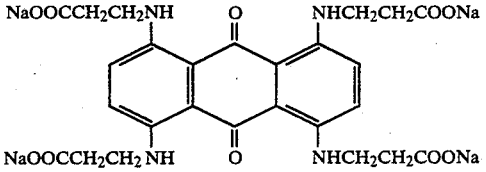
47
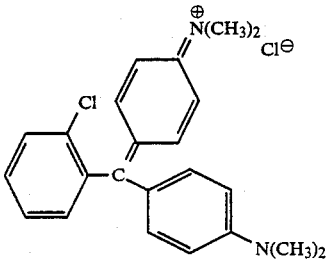

-continued

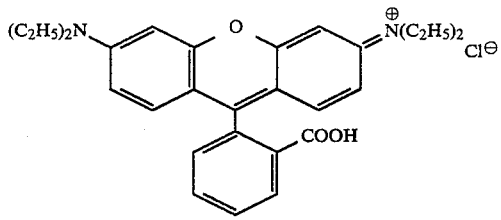

Of these dyes, dyes of Nos. 1–4, 12–16, 18–19, 22–27, 29 and 43–45 are eluted or decolored from the polymer matting agents during development.

The dyes for use in the present invention can be synthesized by the methods described in Yutaka Hosoda, *Senryo Kagaku* (*Dye Chemistry*), Gihodo; Kenzo Konishi & Nobuhiko Kuroki, *Gosei Senryo no Kagaku* (*Chemistry of Synthetic Dyes*), Maki-shoten; and F. M. Hamer, *Heterocyclic Compounds—Cyanine dyes and Related Compounds,* John Wiley & Sons, and methods similar thereto.

The ratio of polymers to dye depends on the required optical density and the amount of dye to be coated per unit area of polymer. The dye is used in an amount of preferably from 0.01% to 30% by weight, more preferably 0.1% to 10% by weight, based on the polymer.

Use of a smaller amount of dye results in an inadequate effect and the excessive amount thereof causes stains after development.

The polymer matting agent is coated on the photographic material in an amount of from 0.01 to 1.0 g/m$^2$, and preferably from 0.02 to 0.5 g/m$^2$. The dyes for use with the polymer matting agents should substantially absorb the light to which the photographic materials are exposed, to the extent that the light sensitivity is changed. In case of exposure of the photographic materials to ultraviolet rays, the polymer is desirably dyed with ultraviolet ray-absorbing dyes. In case of exposure of the photographic materials to visible rays, the polymer is preferably dyed with visible ray absorbing dyes. It is desirable to use dyes which have a maximum absorption in the region covering the wavelength of the exposure light, preferably the region ±100 nm of the wavelength of the exposure light.

The silver halide emulsions of the present invention may comprise compositions selected from silver chloride, silver chlorobromide, silver iodobromide and silver iodochlorobromide. For contact work photographic materials, the silver halide preferably contains from 60 mol % or more and particularly 75 mol % or more of silver chloride. Silver chlorobromide or chloroiodobromide containing from 0 to 5 mol % of silver bromide is preferable.

In case of dot process photographic materials, the silver halide preferably contains 70 mol % or more and particularly 90 mol % or more of silver bromide. The content of silver iodide is preferably 10 mol % or less, and more preferably from 0.1 to 5 mol %.

The silver halide of the present invention has a fine grain structure with an average grain size of preferably 0.03 μm to 0.7 μm, and more preferably 0.03 μm to 0.5 μm. There is no limit with respect to grain size distribution, but a monodisperse system is preferable. A monodisperse system herein means that at least 95% by weight or number of grains are within ±40% of the average grain size.

The silver halide grains in the photographic emulsions of the present invention may comprise regular cubic or octahedral crystals or irregular spherical or plate crystals or combinations thereof. Cubic crystals are preferred.

The silver halide grains of the present invention may consist of a uniform phase or of different phases with respect to the inside and the surface layer of the grains. Two or more silver halide emulsions separately prepared may be mixed and used together.

The silver halide emulsions of the present invention may include cadmium salts, sulfites, lead salts, thallium salts, rhodium salts or complexes thereof and iridium salts or complexes thereof, at the formation of silver halide grains or the physical ripening.

Rhodium salts for use in the present invention include rhodium monochloride, rhodium dichloride, rhodium trichloride, and ammonium hexachlororhodate. Preferred rhodium compounds include halogeno complex compounds of water-soluble trivalent rhodium such as hexachlororhodium (III) acid or hexachlororhodates thereof (e.g., ammonium hexachlororhodate, sodium hexachlororhodate, potassium hexachlororhodate).

These water-soluble rhodium salts are added in an amount of from $1.0\times10^{-8}$ to $1.0\times10^{-3}$ mol, and preferably from $1.0\times10^{-7}$ to $5.0\times10^{-4}$ mol per mol of silver halide.

The silver halide emulsions for use in the present invention may be chemically sensitized by means of sulfur sensitization, reduction sensitization, and noble metal sensitization alone or combination thereof.

Gold sensitization is typical of these noble metal sensitization methods and mainly employs gold complexes, which may contain noble metals other than gold, e.g., complexes of platinum, palladium, and iridium. Examples thereof are described in U.S. Pat. No. 2,448,060 and British Patent No. 618,061.

Sulfur sensitizers for use in the present invention include sulfur compounds contained in gelatin, and various sulfur compounds such as thiosulfate, thioureas, thiazoles and rhodanines.

Reduction sensitizers for use in the present invention include stannous salts, amines, formamidine sulfinic acid and silane compounds.

Spectrally-sensitizing dyes may be added to the silver halide emulsion layers of the present invention. These sensitizing dyes including combinations of dyes showing supersensitization, and substance showing supersensitization are described in *Research Disclosure,* No. 176, 17643 (issued December, 1978), page 23, IV-J.

Gelatin is advantageously used as the binders or protective colloid of the photographic emulsions of the present invention, but other hydrophilic colloids can be used. For example, various synthetic hydrophilic high molecular weight substances of homopolymers and copolymers can be used such as proteins (e.g., gelatin derivatives, graft copolymers of gelatin and other high polymers, albumin, casein); cellulose derivatives (e.g., hydroxyethyl cellulose, carboxymethyl cellulose, cellulose sulfates); sugar derivatives (e.g., sodium alginate, starch derivatives); polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

Lime-treated gelatin, acid-treated gelatin, gelatin hydrolyzate, and gelatin enzyme decomposition products may be used in the present invention.

In order to prevent photographic fog and to stabilize photographic qualities in the fabrication, storage or processing of photographic materials, the photographic materials can contain antifoggants and stabilizers which include various compounds such as azoles (e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles); mercaptopyrimidines; mercaptotriazines; thioketo compounds such as oxazolinethione; azaindenes (e.g., triazaindenes, tetraazaindenes, particularly, 4-hydroxysubstituted (1,3,3a,7)tetraazaindenes, pentaazaindenes); hydroquinone and derivatives thereof; disulfides (e.g., thioctic acid); benzenethiosulfonic acid, benzene sulfinic acid, and benzenesulfonic acid amide. Of these, benzotriazoles (e.g., 5-methyl-benzotriazole) and nitroindazoles (e.g., 5-nitroindazole) are preferable. Also, these compounds may be contained in the processing solutions.

The photographic materials of the present invention may contain organic desensitizers. Preferred organic desensitizers have at least one water-soluble group or alkali-dissociating group. These organic desensitizers are described in JP-A-No. 63-64039 (the term "JP-A" as used herein means an "unexamined published Japanese patent application"), which are added to silver halide emulsion layers in an amount of from $1.0\times10^{-8}$ to $1.0\times10^{-4}$ mol/m$^2$, and preferably $1.0\times10^{-7}$ to $1.0\times10^{-5}$ mol/m$^2$ of the photographic material.

The photographic materials of the present invention may contain hydrazine derivatives. The method of forming high contrast images using hydrazine derivatives in the field of graphic arts is disclosed in U.S. Pat. Nos. 4,224,401, 4,168,977, 4,166,742, 4,311,781, 4,272,606, 4,211,857, and 4,243,739.

The following are examples of hydrazine derivatives for use in the present invention:

(II-1)

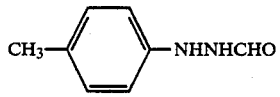

(II-2)

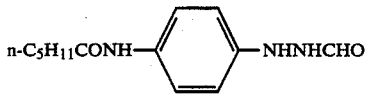

(II-3)

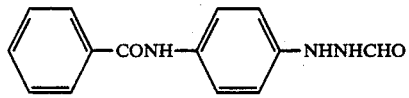

(II-4)

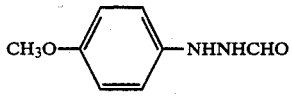

(II-5)

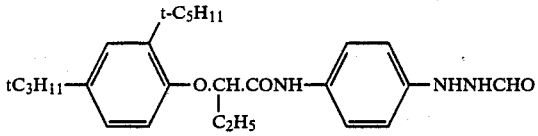

(II-6)

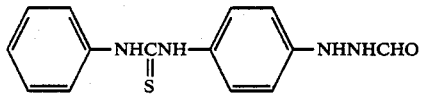

(II-7)

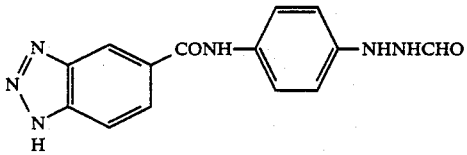

(II-8)

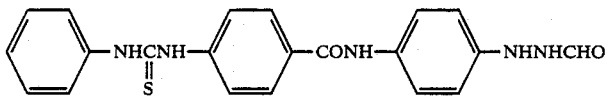

-continued
(II-9)
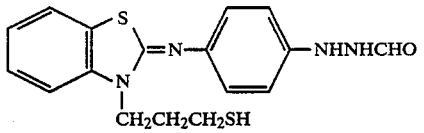
(II-10)
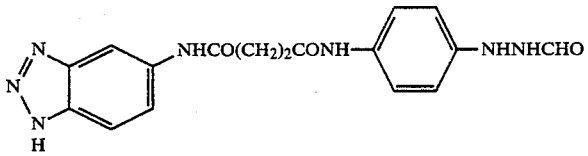
(II-11)
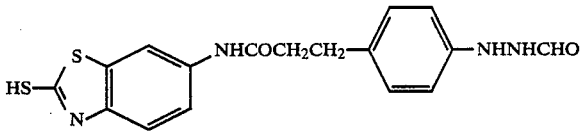
(II-12)
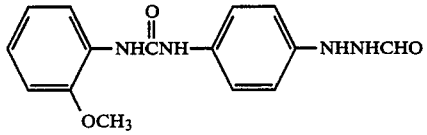
(II-13)
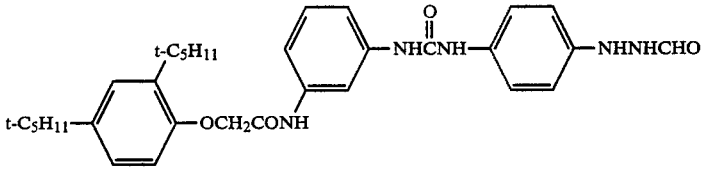
(II-14)
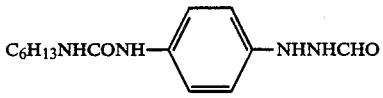
(II-15)
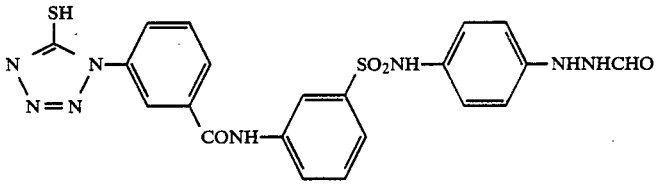
(II-16)
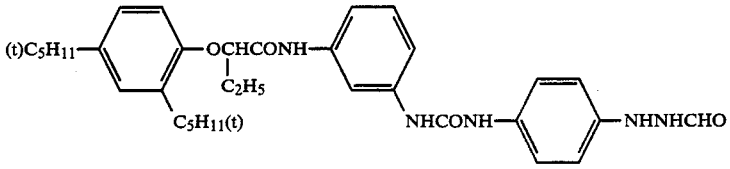
(II-17)
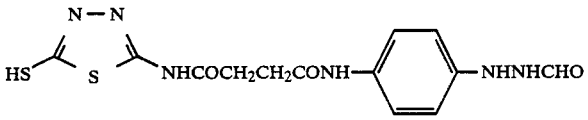
(II-18)
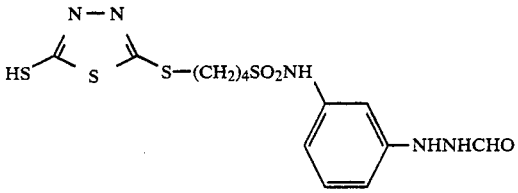

-continued
(II-19)
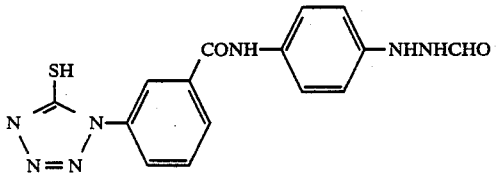
(II-20)
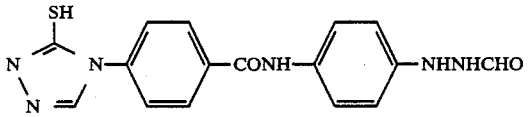
(II-21)
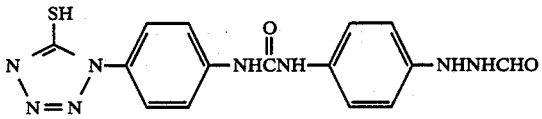
(II-22)
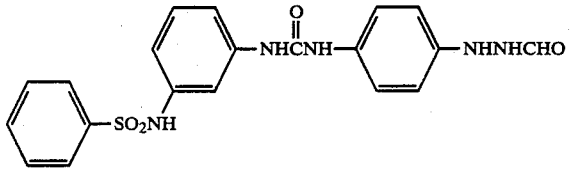
(II-23)
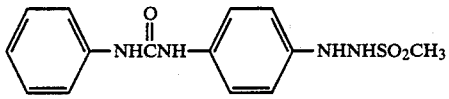
(II-24)
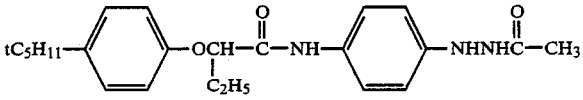
(II-25)
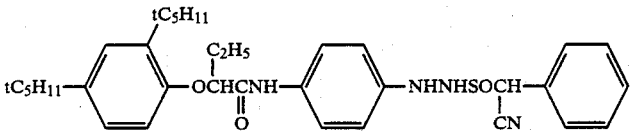
(II-26)
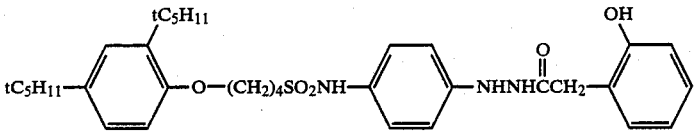
(II-27)
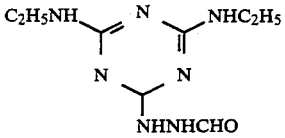
(II-28)
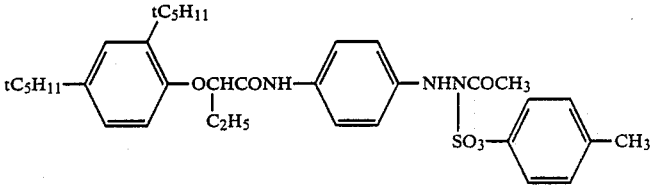

-continued

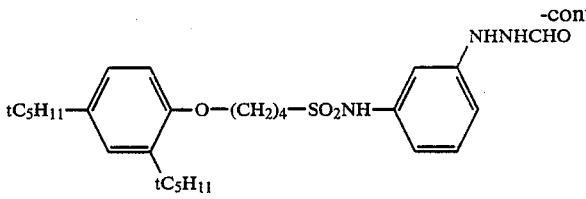

(II-29)

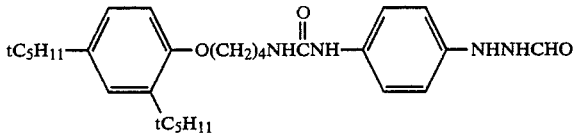

(II-30)

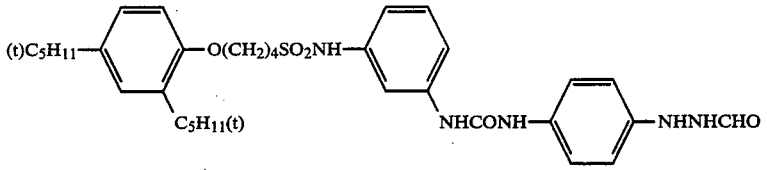

(II-31)

In addition to the above hydrazine derivatives, other hydrazine derivatives for use in the present invention are described in *Research Disclosure,* Item 23516 (issued November, 1983), p. 346) and the literature cited therein, U.S. Pat. Nos. 4,080,207; 4,269,929; 4,276,364; 4,278,748; 4,385,108; 4,459,347; 4,560,638; and 4,478,928; British Patent No. 2,011,391B; and JP-A-No. 60-17973.

Hydrazine derivatives are contained in the photographic materials of the present invention in an amount of from preferably $1\times10^{-6}$ mol to $5\times10^{-2}$ mols, and more preferably $1\times10^{-5}$ to $2\times10^{-2}$ mols per mol of silver halide.

Supports for use in the present invention include glass, cellulose acetate film, polyethylene terephthalate film, paper, baryta paper, polyolefin (e.g., polyethylene, polypropylene)-laminated paper, polystyrene film, polycarbonate film and metal plate such as alumina. These supports may be treated with corona discharge by a known method, or may be coated with subbing layers by known methods, as desired.

The emulsion layers or other hydrophilic colloidal layers of the present invention preferably contain non-diffusible or water-soluble dyes as filter dyes, irradiation-preventing dyes, etc. Filter dyes are those which lower photographic sensitivity, and preferably have substantial light-absorption mainly in the region of from 310 nm to 600 nm in order to allow use of a safelight when the photographic materials are treated in a bright room. Ultraviolet ray-absorbing agents having a spectral absorption maximum in the intrinsic sensitivity region of silver halide also are preferably used in the present invention as the filter dyes.

These dyes are preferably added to the silver halide emulsion layers according to the desired purpose or added and fixed with mordants in the layer provided on the upper side of the emulsion layers, i.e., the light-insensitive hydrophilic colloidal layer disposed farthest from the base.

These dyes are added in an amount of from $10^{-3}$ g/m$^2$ to 1 g/m$^2$, and preferably from 10 mg to 500 mg/m$^2$ of the photographic material.

The above dyes can be dissolved in suitable solvents such as water, alcohol (e.g., methanol, ethanol, propanol), acetone, methyl cellosolve, and mixtures thereof for addition to the emulsion and other colloidal coating solutions.

These dyes can be used in combination thereof.

Examples of these dyes are described in JP-A-No. 63-64039.

Examples of the nondiffusible dyes are described in JP-A-NO. 63-208846 and Japanese Patent Application No. 62-118519.

The present invention can employ such ultraviolet ray-absorbing dyes as described in U.S. Pat. Nos. 3,533,794; 3,314,794; 3,352,681; 3,705,805; 3,707,375; 4,045,229; 3,700,455; and 3,499,762; JP-A-No. 46-2784; and West German Patent Publication No. 1,547,863.

The present invention can also employ pyrazolone oxonol dyes as described in U.S. Pat. No. 2,274,782; diaryl azo dyes described in U.S. Pat. No. 2,956,879; styryl dyes and butadienyl dyes as described in U.S. Pat. Nos. 3,423,207 and 3,384,487; merocyanine dyes as described in U.S. Pat. No. 2,527,583; merocyanine dyes and oxonol dyes as described in U.S. Pat. Nos. 3,486,897; 3,652,284 and 3,718,472; enaminohemioxonol dyes as described in U.S. Pat. No. 3,976,661; and dyes described in British Patents 584,609 and 1,177,429; JP-A-No. 48-85130; JP-A-No. 49-99620; JP-A-No. 49-114420; U.S. Pat. Nos. 2,533,472; 3,148,187; 3,177,078; 3,247,127; 3,540,887; 3,575,704; and 3,653,905.

The photographic emulsion layers and other hydrophilic colloidal layers of the photographic materials of the present invention may contain organic or inorganic hardening agents, such as chrome salts (e.g., chrome alum, chromium acetate), aldehydes (e.g., formaldehyde, glyoxal, glutaraldehyde), N-methylol compounds (e.g., dimethylolurea, methyloldimethyl hydantoin), dioxane derivatives (e.g., 2,3-dihydroxydioxane), active vinyl compounds (e.g., 1,3,5-triacryloyl-hexahydro-s-triazine, 1,3-vinylsulfonyl-2propanol), active halogen compounds (e.g., 2,4-dichloro-6-hydroxy-s-triazine), mucohalogeno acids (e.g., mucochloric acid, mucophenoxychloric acid), epoxy compounds (e.g., tetramethylene glycol diglycidylether), and isocyanate compounds (e.g., hexamethylene diisocyanate) alone or in combination thereof.

The present invention can also employ high polymer hardening agents as described in JP-A-No. 56-66841, British Patent No. 1,322,971 and U.S. Pat. No. 3,671,256.

The photographic emulsion layers and other hydrophilic colloidal layers of the photographic materials of the present invention can contain various surfactants as coating aids, antistatic agents, antisliding agents, emulsion dispersants, adhesion-preventing agents and photographic characteristics-improving agents (e.g., development accelerators, contrast-increasing agents, sensitizers).

Surfactants for use in the present invention include nonionic surfactants such as saponin (steroid saponin), alkylene oxide derivatives (e.g., polyethylene glycol, polyethylene glycol/polypropylene glycol condensate, polyethylene glycol alkylethers or polyethylene glycol alkylarylethers, polyethylene glycol esters, polyethylene glycol sorbitan esters, polyalkylene glycol alkylamines or amides, polyethylene oxide additives of silicone), glycidol derivatives (e.g., polyglyceride alkenylsuccinate, alkylphenol polyglyceride), fatty acid esters of polyhydric alcohol, and alkyl ester acid of sugar; anionic surfactants having acid groups such as carboxy group, sulfo group, phospho group, sulfate group, and phosphate group such as alkylcarboxylic acid salt, alkyl sulfonate, alkylbenzene sulfonate, alkylnaphthalenesulfonate, alkylsulfates, alkylphosphates, N-acyl-N-alkyltaurines, sulfosuccinates, sulfoalkylpolyoxyethylenealkylphenyl ethers, and polyoxyethylenealkylphosphates; and amphoteric surfactants such as amino acids, aminoalkylsulfonic acids, aminoalkylsulfuric acid or phosphates, alkylbetaines, and amine oxides; and cationic surfactants such as alkyl amine salts, aromatic or aliphatic quaternary ammonium salts, heterocyclic quaternary ammonium salts such as pyridinium and imidazolium, and aliphatic or heterocyclic ring-containing phosphonium or sulfonium salts.

The surfactants preferably used in the present invention are polyalkylene oxides having a molecular weight of 600 or more as described in JP-B-58-9412 (the term "JP-B" as used herein means to an "examined Japanese patent publication"). Also, a polymer latex such as polyalkylacrylate can be added for dimensional stability.

The silver halide photographic materials of the present invention containing a hydrazine derivative can be used to obtain the photographic characteristics of superhigh contrast using a stable developer and without the use of a conventional infectious developer and the highly alkaline developer of pH about 13 described in U.S. Pat. No. 2,419,975.

Namely, the present invention can produce negative images having sufficiently superhigh contrast using a developer containing at least 0.15 mol/liter of sulfite ion as a preservative with pH of from 10.5 to 12.3, and particularly from 11.0 to 12.0.

There is no particular limitation in selection of the developing agents contained in the developer which can be used in the present invention, which may include dihydroxybenzenes (e.g., hydroquinone), 3-pyrazolidones (e.g., 1-phenyl-3-pyrazolidone, 4,4-dimethyl-1-phenyl-3-pyrazolidone), and aminophenols (e.g., N-methyl-p-aminophenol) alone or in combination thereof.

The silver halide photographic materials of the present invention are properly processed in developers containing dihydroxybenzenes as the main developing agent and 3-pyrazolidones or aminophenols as the developing aids. Preferably, the above developer contains dihydroxybenzenes in an amount of from 0.05 to 0.5 mol/liter and 3-pyrazolidones or aminophenols in an amount of from 0.06 mol/liter or less.

As described in U.S. Pat. No. 4,269,929, the addition of amines to the developer increases developing speed and shortens the developing time.

Moreover, the developer of the present invention can contain pH buffers including sulfites, carbonates, borates and phosphates of alkali metal, development restrainers including bromides, iodides, and organic antifoggants (preferably, nitroindazoles or benzotriazoles), and other antifoggants; and, if desired, may contain hard-water softening agents, dissolving aids, toning agents, development accelerators, surfactants (most preferably polyalkylene oxides described above), defoaming agents, hardening agents, and film silver-stain preventing agents (e.g., 2-mercaptobenzimidazole sulfonic acids).

The present invention can employ fixers of typical composition. Fixing agents for use in the present invention include thiosulfates, thiocyanates, and organic sulfur compounds effective as fixers. The fixers may contain water-soluble aluminium salts as hardening agents.

The photographic processing of the present invention is usually carried out at a temperature between 18° C. and 50° C.

The photographic processing of the present invention is preferably carried out using an automatic developing machine so that the total processing time from introduction of the photographic materials into the machine to recovery of the same is set in a range of 90 to 120 seconds to obtain satisfactory superhigh contrast negative gradation of the photographic characteristics.

The developer used in the present invention can contain the compounds described in JP-A-No. 56-24347 as silver-stain preventing agents, and the compounds described in JP-A-No. 61-267759 as dissolving aids. Moreover, the developer used in the present invention can contain the compounds described in JP-A-No. 60-93433 and the compounds described in JP-A-No. 62-186259 as pH buffers.

The present invention is illustrated more in detail by the following Examples. It is to be noted that the following developer was used in the Examples below. Unless other wise indicated all parts, percents, ratios and the like are by weight.

| Developer | |
|---|---|
| Hydroquinone | 50.0 g |
| N-methyl-p-aminophenol | 0.3 g |
| Sodium hydroxide | 18.0 g |
| 5-Sulfosalycylic acid | 55.0 g |
| Potassium sulfite | 110.0 g |
| Sodium ethylenediaminetetraacetate | 1.0 g |
| Potassium bromide | 10.0 g |
| 5-Methylbenzotriazole | 0.4 g |
| 2-Mercaptobenzimidazole-5-sodium sulfonate | 0.3 g |
| 3-(5-mercaptotetrazole) sodium benzenesulfonate | 0.2 g |
| N-n-butyldiethanolamine | 15.0 g |
| Sodium toluenesulfonate | 8.0 g |
| Water to make | 1 liter |
| | pH = 11.6 |
| (adjusted by adding potassium hydroxide) | |

EXAMPLE 1

An aqueous solution of silver nitrate and an aqueous solution of sodium chloride were simultaneously added to an aqueous solution of gelatin kept at 30° C. in the presence of $5.0\times10^{-5}$ mol of $(NH_4)_3RhCl_6$ per mol of silver. Then, the soluble salts were removed by a flocculation method well-known in the art, and more gelatin was added. Next, 2-methyl-4-hydroxy 1,3,3a,7-tetraazaindene was added in an amount of 1.0 wt % based on gelatin to the solution as a stabilizer without chemical ripening. The thus obtained emulsion was a monodispersed silver chloride emulsion having an average grain size of 0.08 μm in the form of cubic crystals. 8

Next, 9 mg/m² of a hydrazine derivative represented by the following formula:

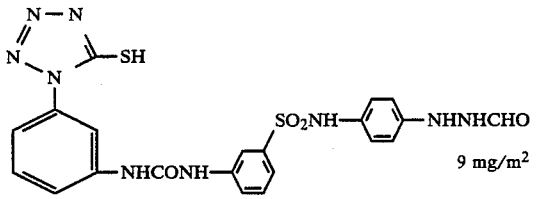

and then 15 mg/m² of a nucleation accelerator represented by the following formula:

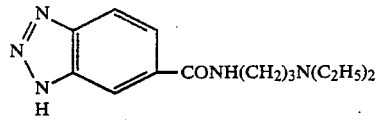

were added to the emulsion.

Moreover, solid polyethyl acrylate latex was added in an amount of 30 wt % based on gelatin, and 1,3-vinylsulfonyl-2-propanol was added in an amount of 100 mg per mol of silver as a hardening agent. The resulting emulsion was coated on a polyester support to obtain silver in an amount of 3.8 g/m² and gelatin in an amount of 1.8 g/m². A protective layer consisting of 1.5 g/m² of gelatin, 0.3 g/m² of the polymer matting agent given in Table 1, and the following surfactants, stabilizer and ultraviolet-ray-absorbing dye was applied on the above coating. This sample was then dried.

| | |
|---|---|
| Surfactants | |
| 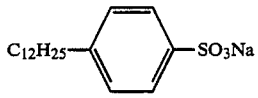 | 37 mg/m² |
| $CH_2COOC_6H_{13}$<br>\|<br>$CHCOOC_6H_{13}$<br>\|<br>$SO_3Na$ | 37 mg/m² |
| $C_8F_{17}SO_2N(C_3H_7)CH_2COOK$ | 2.5 mg/m² |
| Stabilizer | |
| Thioctic acid | 2.1 mg/m² |
| Ultraviolet-ray-absorbing dye | |
| 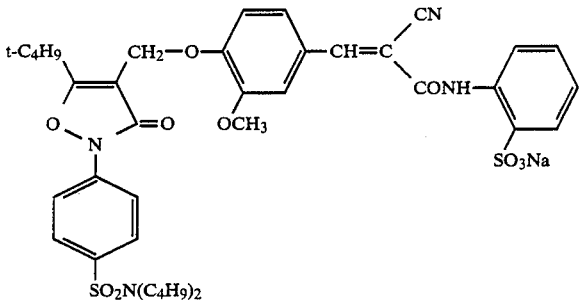 | 100 mg/m² |

The polymer matting agent was prepared by the following process. First, 100 g of polymethyl methacrylate (having an average molecular weight of about 100,000) and 4.1 g of a dye (Dye-3) represented by the following formula were dissolved in 340 g of methylenechloride.

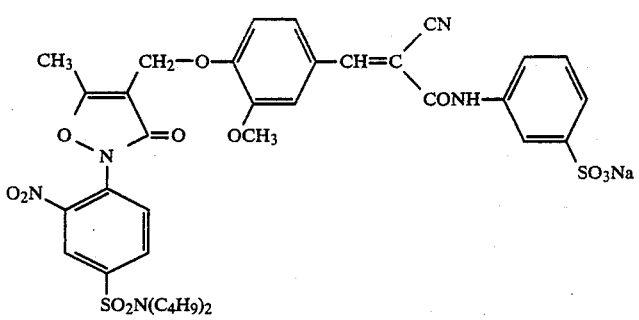

(Dye-3)

Separately, 32 g of gelatin and 3.5 g of sodium cetylbenzenesulfonate were dissolved in 450 ml of water with vigorous stirring at 40° C. and the previously prepared methylene chloride solution was added thereto and stirred for 20 minutes. The resulting white paste was heated to 85° C. to evaporate the methylenechloride thus obtaining a dye-matting agent having an average grain size of 2.5 μm.

Matting agents containing other dyes as indicated in Table 1 were prepared in a manner similar as above. Also, a matting agent containing no dye was prepared in a similar manner for the comparative sample (Comparison Sample-A).

These samples were exposed to the light using a model P-617DQ printer made by Dainippon Screen Mfg. Co., Ltd. (light source: 100V, 1 KW, quartz halogen lamp) through an optical wedge; developed at 38° C. for 20 seconds using an automatic developing machine FG-660F made by Fuji Photo Film Co., Ltd., fixed by an ordinary acid hardening fixer for 15 seconds, washed for 40 seconds and hot-air dried.

The evaluation results are shown in Table 1. Many black spots were observed in Comparison Sample A, but no black spots were observed in Samples 1-1 to 1-4 of the present invention. Also, the highlight parts obtained after development processing in the samples of the present invention using Dye-3 and Dye-4 advantageously had a higher value of ultraviolet ray transmission as compared to those using Dye-8 and Dye-9.

EXAMPLE 2

In a manner similar to Example 1, $5.0\times10^{-6}$ mol of $(NH_4)_3RhCl_6$ was added per mol of silver to obtain a monodispersed AgCl emulsion having an average grain size of 0.15 μm in the form of cubic crystals.

To this emulsion were added 31 mg/m$^2$ of a hydrazine derivative, 15 mg/m$^2$ of a nucleation accelerator, and 50 mg/m$^2$ of each of yellow dyes represented by the following formulae:

Hydrazine derivative — 31 mg/m$^2$

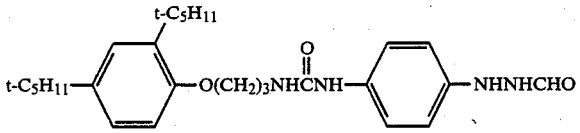

Nucleation accelarator — 15 mg/m$^2$

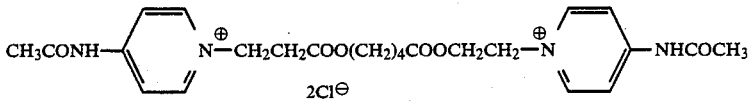

Yellow dyes — 50 mg/m$^2$

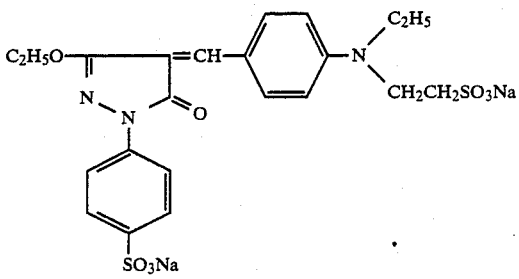

-continued 50 mg/m²

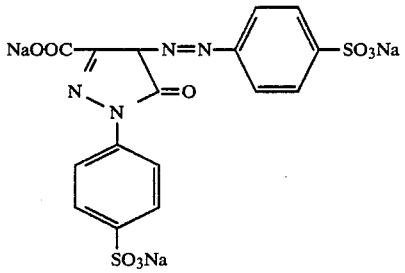

Moreover, solid polyethyl acrylate latex was added in an amount of 30 wt % based on gelatin, and 1,3-vinylsulfonyl-2-propanol was added in an amount of 1.0 wt % based on gelatin as a hardenin agent. The resulting solution was coated on a polyester support to obtain silver in an amount of 3.8 g/m² and gelatin in an amount of 1.8 g/m².

A protective layer consisting of 1.5 g/m² of gelatin, 0.3 g/m² of the polymer matting agent shown in Table 2, the same coating aids and stabilizer in the same amounts as given in Example 1 was applied on the above coating. The polymer matting agent was prepared in a manner similar to Example 1. Yellow dye-14 and the dye-15 were incorporated into the matting agent.

These samples were exposed to the light though an optical wedge using a model P-627 FM printer made by Dainippon Screen Mfg. Co., Ltd. (light source: Magnelux MD-P-1200, 1.5 KW; optical filter DIALITE P-1001, 3 mm thick, made by Mitsubishi Rayon Co., Ltd.).

The light transmission of DIALITE P-1001 filter was 50% at 393 nm. Therefore, this filter absorbed light in the shorter wavelength regions and transmitted the light in the longer wavelength regions.

The exposed samples were developed, fixed and washed as in Example 1.

As clearly shown in Table 2, no black spots were found on Samples 2-1 and 2-2 of the present invention.

EXAMPLE 3

A polyester support undercoated with gelatin on both sides thereof (100 μm thick) was formed. On one side of the polyester support having a subbing layer a layer was applied consisting of gelatin (2.7 g/m²), a mixture of dyes represented by the following formulae in the given amounts, polyethyl acrylate latex having an average molecular weight of 30,000 (0.5 g/m²), coating aids represented by the following formulae and a gelatin hardening agent in an amount of 1.0 wt % based on gelatin as the backing layer. A protective layer was further formed thereon consisting of gelatin (0.8 g/m²), the same matting agent as used in Example 1 (0.3 g/m²) and sodium acetate (40 mg/m²). A comparison sample was prepared in a similar manner by using a matting agent containing no dye (Comparison sample-C).

Dyes 35 g/m²

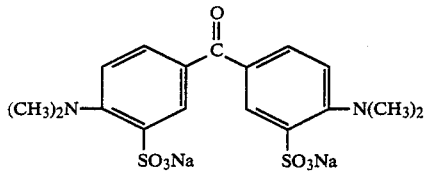

150 g/m²

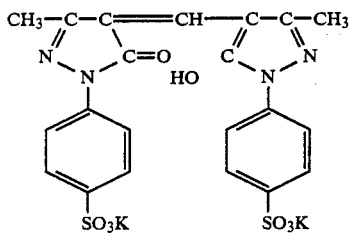

40 g/m²

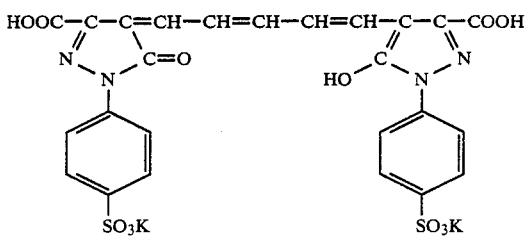

-continued

| | |
|---|---|
| 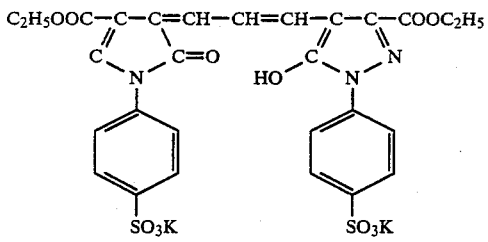 | 30 mg/m$^2$ |
| Coating aids | |
| 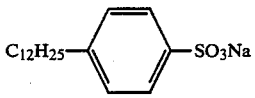 | 10 mg/m$^2$ |
| $CH_2COOC_6H_{13}$<br>\|<br>$CHCOOC_6H_{13}$<br>\|<br>$SO_3Na$ | 5 mg/m$^2$ |
| $C_8F_{17}SO_2N(C_3H_7)CH_2COOK$ | 2 mg/m$^2$ |
| Hardening agent | |
| 1,3-divinylsulfonyl-2-propanol | 0.14 g/m$^2$ |

On the side of the polyester support opposite to these backing layers, a photographic emulsion layer and a protective layer was applied in a manner similar to Example 1. The sample thus obtained was opposed to the light from the side of the backing layers. The same machine and devices as in Example 1 were used.

The sample of Example 3 (invention) and Comparison Sample-C were evaluated. Black spots were found in Comparison Sample-C but not in the sample of Example 3.

TABLE 1

| | Sample No. | Matting agent: Polymer | Matting agent: Dye | Matting agent: Amount of dye per 100 g of polymer | Photographic characteristics: Sensitivity*1 | Photographic characteristics: Black spots*2 | Photographic characteristics: UV transmission (%)*3 |
|---|---|---|---|---|---|---|---|
| 1 | Present invention 1-1 | Polymethyl methacrylate (average molecular weight of about 100,000) | Dye-3 | 4.1 g | 100 | None | 74 |
| 2 | Present invention 1-2 | Polymethyl methacrylate (average molecular weight of about 100,000) | Dye-4 | 4.3 g | 99 | None | 74 |
| 3 | Present invention 1-3 | Polymethyl methacrylate (average molecular weight of about 100,000) | Dye-8 | 1.0 g | 98 | " | 70 |
| 4 | Present invention 104 | Polymethyl methacrylate (average molecular weight of about 100,000) | Dye-9 | 0.7 g | 98 | " | 69 |
| 5 | Comparison Sample-A | Polymethyl methacrylate (average molecular weight of about 100,000) | None | — | 100 | 100 or more | 75 |

*1A relative value of the reciprocal of exposure to give a density of 1.5 (relative sensitivity).
*2Black spots were obtained by observing the toes of the characteristic curves of the developed strips with a loupe of 100 magnifications.
*3UV transmission values were obtained by measuring the transmission of the unexposed portions of the developed strips at a wavelength of 360 nm.

TABLE 1

| | Sample No. | Matting agent: Polymer | Matting agent: Dye | Matting agent: Amount of dye per 100 g of polymer | Photographic characteristics: Sensitivity (S)*1 | Photographic characteristics: Black spots*2 | Photographic characteristics: Remaining color*4 |
|---|---|---|---|---|---|---|---|
| 1 | Present invention 2-1 | Polymethyl methacrylate (average molecular weight of about 100,000 | Dye-14 | 3.8 g | 100 | No | + |
| 2 | Present invention 2-2 | Polymethyl methacrylate (average molecular weight of about 100,000 | Dye-15 | " | 99 | " | + |
| 3 | Comparison Sample B | Polymethyl methacrylate (average molecular weight of about 100,000 | — | — | 100 | 100 or more | ± |

*4Remaining color: the unexposed portion after development was visually observed.
±: Remaining color was hardly recognized.
−: Remaining color was slightly recognized, but exerted no harmful influence in practical use.
++: Remaining color exerted harmful influence in practical use.

EXAMPLE 4

Three samples were prepared in a manner similar to Example 1 except using polyacrylamide having an average molecular weight of about 300,000 (Example 4-1), polyethylmethacrylate having an average molecular weight of about 100,000 (Example 4-2), and a copolymerized resin of methylmethacrylate and methacrylic acid in a copolymerization ratio of 80:20 and an average molecular weight of 50,000 (Example 4-3) instead of polymethylmethacrylate as a polymer. The resulting samples thus exposed, processed and evaluated as in Example 1 were found to have no black spots.

EXAMPLE 5

Aqueous solutions of silver nitrate, potassium iodide and potassium bromide were simultaneously added to an aqueous solution of gelatin kept at 50° C. during the course of 60 minutes in the presence of $4\times10^{-7}$ mol of potassium iridium (III) hexachloride and ammonia, while pAg was kept constant at 7.8. A cubic monodispersed silver iodobromide emulsion (Br: 99.7 mol %; I: 0.3 mol %) was thus prepared having an average grain size of 0.28 μm and an average silver iodide content of 0.3 mol %. This emulsion was desalted by flocculation. Then, 40 g of inert gelatin was added per mol of silver and kept at 50° C., to which 5,5'-dichloro-9-ethyl-3,3'-bis(3-sulfopropyl)oxacarbocyanine and $10^{-3}$ mol of potassium iodide aqueous solution per mol of silver were added. The solution was allowed to stand for 15 minutes and then cooled to form a gel. This gel was again dissolved at 40° C., to which was added 0.02 mol of methylhydroquinone, $4\times10^{-4}$ mol of the compound represented by the following formula (a), $1.2\times10^{-3}$ mol of hydrazine derivative II-5, and $0.5\times10^{-4}$ mol of hydrazine derivative II-15, all per mol of silver. Further, 5-methylbenzotriazole, 4-hydroxy-1,3,3a,7-tetraazaindene, the compounds of the following formulae (b) and (c), a polyethylacrylate dispersion and the compound of the following formula (d) as a gelatin hardening agent were added to the gel. The thus obtained solution was coated on a polyethylene terephthalate film (150 μm thick) having subbing layers (0.75 μm thick) consisting of vinylidene chloride copolymer on both sides thereof to obtain a photographic material having 3.4 g/m² of coated silver.

(a) $4\times10^{-4}$ mol/mol Ag

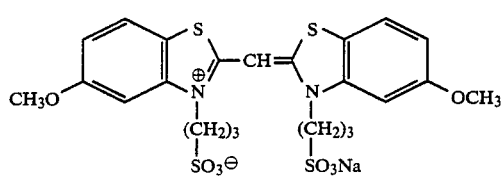

(b) 8 mg/m²

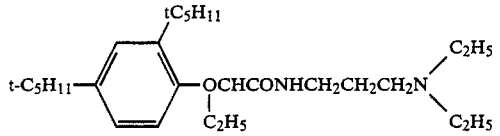

(c) 15 mg/m²

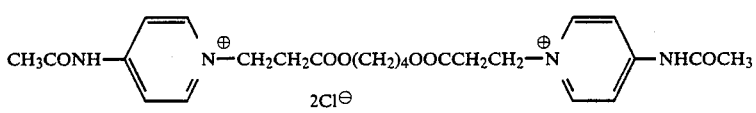

(d) 1.0 wt % (based on gelatin)

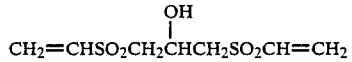

The surface protective layer of Sample 1-1 of Example 1 was applied thereon to produce Sample 5. In a manner similar to Example 1, Sample 5 was exposed, processed and evaluated. Few black spots were recognized on the material had good photographic characteristics.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, wherein said emulsion layer or another hydrophilic colloid layer contains a colored polymer matting agent which comprises a dye absorbed to a polymer.

2. A silver halide photographic material as in claim 1, wherein said silver halide emulsion layer contains a hydrazine derivative.

3. A silver halide photographic material as in claim 1, wherein said polymer is selected from the group consisting of an acryl resin, a vinyl chloride resin, a vinyl acetate resin, a styrol resin, a vinylidene chloride resin, an acetal resin and a cellulose resin or combinations thereof.

4. A silver halide photographic material as in claim 1, wherein said polymer has a grain size of from 0.5 to 5.0 μm.

5. A silver halide photographic material as in claim 1, wherein said dye substantially absorbs light in the same wavelength region as that to which said photographic material is exposed.

6. A silver halide photographic material as in claim 5, wherein said dye is selected from the group consisting of cyanine dyes, merocyanine dyes, hemicyanine dyes, oxonol dyes, styryl dyes, benzylidene dyes, azo dyes, azomethine dyes, anthraquinone dyes, diphenylmethane dyes, triphenylmethane dyes, acridine dyes, xanthene dyes, diaminostilbene dyes, benzophenone dyes, benzotriazole dyes, cinnamic acid dyes and aminobutadiene dyes.

7. A silver halide photographic material as in claim 1, wherein said dye is present in an amount of from 0.1% to 10% by weight of said polymer matting agent.

8. A silver halide photographic material as in claim 1, wherein said colored matting agent is coated on said photographic material in an amount of from 0.02 to 0.5 $g/m^2$.

9. A silver halide photographic material as in claim 1, wherein said colored polymer matting agent is present in a protective layer disposed farthest from said support and on the same side of said support having the silver halide emulsion layer.

10. A silver halide photographic material as in claim 1, wherein said colored polymer matting agent is present in a protective layer disposed farthest from said support on the side of said support opposite to that having the silver halide emulsion layer.

* * * * *